United States Patent [19]

Cooley

[11] 3,930,898

[45] Jan. 6, 1976

[54] PROCESS FOR IMPARTING A DARK PATINA TO LOW-MELTING METAL ARTICLES

[76] Inventor: Marion S. Cooley, 531 Chisholm Trail, Wyoming, Ohio 45215

[22] Filed: Dec. 17, 1973

[21] Appl. No.: 425,528

[52] U.S. Cl. ..... 148/6.24; 29/199; 148/6.14 R

[51] Int. Cl.[2] ..... C23C 3/00; C23F 5/02

[58] Field of Search ..... 148/6.14 R, 6.24; 117/130 R, 130 E; 29/199

[56] References Cited

UNITED STATES PATENTS

| | | | |
|---|---|---|---|
| 153,726 | 8/1874 | Shaw | 29/199 |
| 282,754 | 8/1883 | Morton | 117/130 R |
| 3,238,059 | 3/1966 | Stobierski | 117/130 R X |
| 3,577,282 | 5/1971 | Schubert | 148/6.24 |

OTHER PUBLICATIONS

Fishlock, "Black Finishes for Metals," Metal Finishing, Sept. 1963, pp. 56–59,65.

*Primary Examiner*—Harris A. Pitlick
*Attorney, Agent, or Firm*—John B. Goodman

[57] ABSTRACT

A process for imparting a dark patina to the surface of an article formed from a low-melting alloy metal, the alloy metal being an alloy metal of two or more metals selected from the group consisting of Bi, Pb, Sn and Cd, comprising exposing the alloy metal surfaces of said article to an acid solution of a copper salt.

5 Claims, No Drawings

PROCESS FOR IMPARTING A DARK PATINA TO LOW-MELTING METAL ARTICLES

BACKGROUND OF THE INVENTION

Low-melting alloy metals of two or more metals selected from the group consisting of bismuth (Bi), lead (Pb), tin (Sn) and cadmium (Cd), have been known for many years. Of particular interest here, and, known heretofore, are such alloy metals having a melting point below 350°F.

An especially interesting example of such alloy metals, commonly called Wood's metal, consists of 50 parts Bi, 25 parts Pb, 12.5 parts Sn and 12.5 parts Cd. This metal and other alloy metals of these components can have especially low melting points, as, for example, melting points below 200°F.

These low-melting metals have recently found increasing use for making jewelry and other decorative items. Articles fashioned from the metals generally have a bright "silver" appearance.

The prior art suggests that to obtain a dark oxidized silver appearance on articles made from low-melting metals that a mixture of black and raw umber paints be applied as a thin coating and partially rubbed off, or be selectively touched into recessed areas of the article (School Arts, February 1970). This prior art method, however, does not provide an ideally authentic appearing dark oxidized silver patina.

Heretofore, the prior art has provided methods for imparting to high melting metals the appearance of the dark oxidized silver patina characteristic of "antique silver." See, for example, U.S. Pat. No. 3,767,475. In addition, copper solutions have been used to color high-melting metals. See, for example, U.S. Pat. Nos. 2,519,672 and 3,615,747.

It would be desirable to impart an authentic appearing dark oxidized silver patina to articles made from low-melting alloy metals in order to provide "antique silver" articles fashioned from low-melting alloy metals.

SUMMARY OF THE INVENTION

In summary, this invention provides a process for imparting a dark patina to the surface of an article formed from a low-melting alloy metal, the alloy metal being an alloy metal of two or more metals selected from the group consisting of Bi, Pb, Sn and Cd having a melting point below 350°F, comprising exposing the alloy metal surface of said article to an acid solution of copper salt. This invention also provides articles having a dark patina formed by this process.

DETAILED DESCRIPTION OF THE INVENTION AND ITS PREFERRED EMBODIMENTS

In its broad aspect, this invention provides a process for imparting a dark patina to the surface of low-melting Bi, Pb, Sn, and Cd alloy metal articles comprising exposing the surface of the metal article to an acid solution of a copper salt for a time sufficient to obtain a dark patina.

The alloy metal articles employed in this invention are alloy metals formed from two or more of the metals selected from the group consisting of Bi, Pb, Sn and Cd which have a melting point below 350°F. The preferred alloy metals are those which include Pb. The most preferred alloy metals are four component Bi-Pb-Sn-Cd metal alloys, especially such alloys having a melting point below 250°F.

The acidic solution of copper employed in this invention can be formed in a variety of ways. For example, a copper salt can be dissolved in an acidic solution. Preferably, the acidic solution is a 0.01M to 1M aqueous solution of a strong mineral acid. Examples of suitable acids are hydrochloric acid, sulfuric acid and nitric acid. Sufficient copper should be dissolved in the acidic solution to obtain a copper concentration of 0.001M to 0.01M. Suitable examples of copper salts include copper chloride and copper sulfate.

A particularly preferred acidic solution of copper salt employed herein is comprised of nitric acid and the copper salt of nitric acid. A convenient method for forming this solution involves dissolving sufficient copper metal in concentrated nitric acid and adding water to obtain concentrated stock solutions containing copper salt concentrations of from about 0.01M to about 1M.

While these stock solutions can be employed, preferably the stock solutions are further diluted to from about 0.001M to about 0.01M copper to obtain preferred solutions for use in this process.

The surface of the low-melting alloy metal article can be exposed to the acidic solution of copper salt in a variety of ways. The article can be wholly or partially dipped in the solution or the solution can be painted onto the article. It is preferred, especially with small articles, to immerse the article in the solution.

The action of the coloring solution proceeds readily at room temperature, but higher temperatures can be employed. The temperature employed, however, should not exceed the melting point of the metal.

The time required to develop the patina will vary depending upon the darkness of the patina desired, the particular metal employed and the concentration of the coloring solution. In preferred embodiments of the process of this invention, a desirable patina can be obtained in one minute or less. Longer times can be employed.

When a desirable patina has developed on the article, the solution should be removed from the article. Preferably, the solution is removed from the article by rinsing the articles with water at room temperature.

In a particularly unexpected aspect of this invention, it has been discovered that for a time shortly after removing the acidic solution from the article the patina can be partially removed by simply rubbing the patina coating, for example, with a cloth. This can be desirable in that it exposes some "silver" areas on the article, heightening the effect of the appearance of antique silver. Some time after treatment, the patina coating tends to set and becomes more difficult to remove. Therefore, when it is desired to impart this preferred antique silver appearance to the articles, preferably the patina is partially removed just after treatment with the acid solution.

The following example provides a specific preferred embodiment of the invention disclosed herein.

Example I

A small article of lacy design was made by hollowing out a design in moist earth clay and pouring molten "Wood's metal" into the form. The clay was removed from the cast metal article.

An acidic solution comprising copper salt and nitric acid was formed by dissolving copper metal in concentrated nitric acid, and adding sufficient water to obtain an 0.1M acid solution having an 0.01M concentration of copper.

The article was immersed in this solution for one minute. The article, darkened to a bluish-black appearance resembling oxidized silver, was removed from this solution and rinsed with water. The article was dried and rubbed briskly with a cloth removing a portion of the dark patina from raised areas of the article. The resulting article had a desirable authentic antique silver finish.

The articles formed by the process of this invention are novel, and desirably duplicate the appearance of articles made from silver.

What is claimed is:

1. A process for imparting a dark patina to the surface of an article formed from a low-melting alloy metal, the alloy metal being an alloy metal of Bi, Pb, Sn and Cd having a melting point below 350°F, comprising exposing the alloy metal surface of said article to a mineral acid solution of a copper salt selected from the group consisting of copper sulfate, copper chloride and copper nitrate.

2. The process of claim 1 wherein the acidic solution of copper salt is an 0.01M to 1 M aqueous solution of a strong mineral acid containing 0.01M to 1M copper salt.

3. The process of claim 2 wherein the acidic solution contains 0.001M to 0.01M copper salt.

4. The process of claim 1 wherein the alloy melts below 250°F.

5. The process of claim 4 wherein the acidic solution is rinsed from the article with water.

* * * * *